US008060971B1

(12) United States Patent
Castelluccio

(10) Patent No.: US 8,060,971 B1
(45) Date of Patent: Nov. 22, 2011

(54) MAGNETIC COSMETIC APPLICATION BRUSH

(76) Inventor: Daniel Castelluccio, New York, NY (US)

( * ) Notice: Subject to any disclaimer, the term of this patent is extended or adjusted under 35 U.S.C. 154(b) by 448 days.

(21) Appl. No.: 12/228,177

(22) Filed: Aug. 11, 2008

(51) Int. Cl.
*A46B 17/00* (2006.01)

(52) U.S. Cl. ..... 15/160; 15/22.1; 15/DIG. 5

(58) Field of Classification Search ..... 15/159.1, 15/160, DIG. 4, DIG. 5, 22.1; 132/317, 320
See application file for complete search history.

(56) References Cited

U.S. PATENT DOCUMENTS

| | | | | |
|---|---|---|---|---|
| 2,806,235 | A * | 9/1957 | Carstairs et al. | 15/22.2 |
| 5,062,672 | A * | 11/1991 | Harris | 294/65.5 |
| 6,513,183 | B2 * | 2/2003 | Dorf | 15/191.1 |
| 7,918,620 | B2 * | 4/2011 | Del Ponte | 401/131 |
| 2003/0233719 | A1 * | 12/2003 | Wolfinger | 15/159.1 |
| 2006/0248669 | A1 * | 11/2006 | Dovellos | 15/159.1 |
| 2006/0265821 | A1 * | 11/2006 | Hause | 15/22.1 |
| 2008/0023020 | A1 * | 1/2008 | Gueret | 132/218 |
| 2008/0138138 | A1 * | 6/2008 | Gueret | 401/24 |

* cited by examiner

*Primary Examiner* — Laura C Guidotti
(74) *Attorney, Agent, or Firm* — Pryor Cashman LLP; Andrew S. Langsam

(57) ABSTRACT

A powder cosmetics brush is provided. The brush has a handle and bristles and a magnetic element within the ferrule, between the handle into the base of the bristles. A magnetic or an electromagnet element attracts fine particles of iron-based or other cosmetic powders or foundations having magnetic-attractive particles and/or cosmetic particles and facilitates the application, distribution and removal of excess powder. The magnetic element is allowed to move within the ferrule such that sweeping and swirling motion causes it to knock against the inside wall of the ferrule to thereby dislodge some of the particles of cosmetic powder. The bristles preferably are flared from one end to the other and are cross-hatched to provide a first tier of longer bristles and a second tier of shorter bristles. The two or more tiers of bristles serve to distribute the powder more evenly on the face since the bristles will more effectively follow the contours of the face. A vibrating element may be disposed in the handle to prevent clumping of the cosmetics powder and assist in even distribution of same.

12 Claims, 1 Drawing Sheet

MAGNETIC COSMETIC APPLICATION BRUSH

BACKGROUND OF THE INVENTION

1. Field of the Invention

The present invention relates to the field of applying cosmetics to one's body, preferably the face, and more specifically to devices that are used to apply cosmetic powders, such as brushes. The device can also be useful in connection with applying, distribution and removal, as desired, of face foundation which can a liquid with iron-oxide particles dispersed therein.

2. Description of Related Art

Women (and some men) have been using body and facial cosmetics for many purposes for many, many years. One such purpose is to conceal less-than-perfect skin, whether that is the complexion, lines, wrinkles, blemishes, moles, etc. The application of the cosmetic is intended to give the impression of a smooth, lineless, wrinkleless, and scar-free face or other body part. Some cosmetic applications to the face are intended to emphasize facial features, e.g., high cheek bones and eye liner and blush. Originally, powder-based cosmetics were applied with a puff or pad onto the skin and then a brush was used to smooth the applied cosmetic and to remove any excess. Over time, however, more and more appliers of cosmetics have sought to eliminate the use of the puff or pad and thus they have dipped their brush directly into the cosmetic (usually a powder) and used the brush to both apply and remove, as well as smooth out, the applied cosmetic.

The use of brushes for this purpose has streamlined the time for application but often results in a non-professional end product. Brushes of the prior art just were not made for application of cosmetic, and their use for smoothing and removal of excess powder has not been uniformly successful as a consequence, at least, of the un-uniform and three dimensional aspect of the human face. This is because, inter alia, conventional brushes just did not take into account the contour of the human face. Thus, excess powder, applied unevenly and left on the face in clumps or visible streaks (where they are unintended for enhancing one's look) can provide an appearance even worse than the original "bad" skin. Also, many ordinary consumers, i.e., non-professional users and appliers of powder-based cosmetics (i.e., typical consumers but overall huge in terms of numbers in the population that use cosmetics) do not initially apply the powders properly. Typically, a consumer will simply skip the puff/pad step and apply the cosmetic powder with a brush, rather than use the puff/pad for application and then use the brush for excess powder removal and ensuring evenness of application. This is a less than ideal method of powder application, and yet it is very common. There exists, therefore, a definite need in the cosmetic industry, for professional and non-professional users of powder cosmetics for a brush which facilitates the smooth and simple application of powder and then allows the user to smooth the application and remove the excess.

The present invention, as will be described, provides a cosmetic brush with anew shape and contour brush head; provides a mechanism for attracting and holding small cosmetic particles (and not picking up clumps from the cosmetic case); allows the even and simple application to a face by swirling the brush so that smoothness of application is provided; and removes excess cosmetic powder by swirling and knocking it off of the face, etc. A highly functional, new, cosmetic brush is thus provided.

There is a long-felt need for a cosmetics brush that can be used to apply powder-based cosmetics evenly and easily, leaving a smooth appearance on the skin, without requiring another tool or device to remove excess powder. The present brush allows a single implement to be used, a brush, both for initial cosmetic application, for movement of the applied cosmetic to various portions of the face, for enhancing uniformity, spreading and smoothing of the applied cosmetic powder and for removal of the excess powder. The present invention solves many of the prior art existing problems.

Paint brushes have existed for application of paint, varnish, stain, etc. to walls, exteriors of homes, to canvas, etc. These brushes have been provided with flat tips of bristles and bristles of varying lengths.

Also, brushes have been provided for use by police and FBI authorities in connection with providing and then removing dusting powder to flat and other surfaces as a consequence of seeking fingerprints in crime scenes.

SUMMARY OF THE INVENTION

The above and other needs are fulfilled by the present invention, which is a cosmetics brush for applying powder to the body or face, then is highly useful for moving the powder about the body or face (hereinafter collectively for ease of reading referred to as the face) to provide an enhanced visual look to the face and then is also useful for removing excess powder. Brush on cosmetics often contain very small iron oxide particles. The present inventor has discovered that the use of a small magnet located within the cosmetic brush can be used for picking up the small particles and facilitating their application to the face. Correspondingly, by sizing the magnet appropriately, only the relatively smallest of the particles will be picked up by the brush for application and the relatively larger and more clumpy parts of the cosmetic powder will remain behind, within the cosmetic holder (a compact, for example) where the larger particles will either not become applied to the face or will be "beaten" down into smaller and more desirable particles by the swirling movement of the user of the brush within the container of the cosmetic. Thus, on a very basic level, the present invention provides a self-contained magnet for facilitating the picking up of cosmetic face powder for application of the same to the face of the wearer.

The present invention also provides for the magnet within the ferrule (connecting the handle of the brush to the bristles) to be smaller in outside diameter than the inside diameter of the ferrule. The magnet, preferably a small disc, will thus be capable of movement perpendicular to the longitudinal axis of the handle and brush. This movement by the magnet allows it to knock or hit into the inside walls of the ferrule, as the brush is rapidly swirled between the user's fingers or shaken. The movement of the magnet within the ferrule, which has, as mentioned, attracted and helped hold small iron-based or ferro-magnetic particles of the powder to the tips of the bristles of the brush, move the powder along with the movement of the brush and the magnet therein. However, as the magnet knocks or hits into the inside wall of the ferrule (a consequence of the smaller diameter magnet moving within the ferrule and the change of direction by the user's hand by shaking and/or swirling the brush during application) the particles will be swirled about and thrown off by their own momentum. This will occur because the momentum of the particles will exceed the small holding force of the particles to the brush, a consequence of the combination of the bristles attraction and holding the same and the magnet, within the ferrule of the brush. The swirling and removal of the excess powder is considered desirable in that it results in a superior, evenly and well-applied facial cosmetic, with smooth transitions across various areas and depths of the face.

The inventive brush is provided with a handle and bristles disposed at the distal end of the handle. The bristles are secured to the handle by a partially hollow ferrule which is crimped or otherwise secured about the handle and, on its other end, crimped about the bristles.

In one embodiment, the small magnet, within the ferrule, is near the distal end of the handle and preferably so that it protrudes slightly near or even into the base of the bristles. As mentioned, the magnet serves to attract for pick-up, the finest particles of cosmetics powder, which typically include a ferrous or ferromagnetic material. The magnet may be a permanent magnet or an electromagnet. If an electromagnet, then a power supply is also provided in the handle, preferably with an on-off button or switch or similar control mechanism. A power supply in the form of a battery can be connected to the ferrous "magnet" to make it an electro-magnet, when the power/battery is connected to the magnet.

Also, an electric motor can be secured in the handle of the brush and equipped with an eccentric cam element to selectively impart vibration to the bristles, for enhancement of the application of cosmetics. The vibration further ensure uniformity of application and facilitates the removal of excess cosmetics. The vibration provided to the brush can either be directly or indirectly to the bristles or directly or indirectly to the magnetic element. The vibration to the bristles or to the magnetic element will cause the particles which are lightly secured to the bristles or in contact therewith as the brush is moved gently across the face to swirl about the face and off the face, all to positive effect and in the achievement of uniformity of application of powder.

The bristles of the inventive brush are preferably flared and also may include at least two tiers of bristles: a first longer tier of bristles, and a second shorter tier of bristles. The tiers and flaring of the bristle end of the brush is achieved by cross-cutting the same. This provides a brush head which contours about the three-dimensional bumps (cheek bones) and depressions (hollows beneath high cheek bones) and other irregular aspects of a face. Thus, the bristle end of the brush, by the flare and/or the two tiers of bristle sections, results in a superior brush which glides along and over the contours of a face. The present invention provides superior application of cosmetic over a three dimensional face, in contrast to the prior art cosmetic brushes which are more suitable and designed from paint brushes, which are for application of material in just two dimensions.

The two (or more) tier lengths of bristles alternate across the major and minor axis of the brush face (the edge of the brush, preferably defines an oval) and serves to distribute the powder more evenly on the face, because the face is not a flat plane. The two tiers of bristles are preferably distributed in an overlapping manner, with alternating sections of short and long bristles. The tips of each length or tier of bristles preferably substantially form a plane that is at a non-orthogonal angle to the longitudinal axis of the handle. In additional to the tiers of bristles, the entire head end of the brush is flared, again to enhance the movement of powder onto and off of the face, in a uniform manner.

As suggested above, the inventive brush also preferably includes a vibrating element disposed in the handle. By sending vibrations through the handle to the bristles, clumping of the powder is avoided, and a smoother application and removal of the cosmetics is achieved.

DETAILED DESCRIPTION OF THE PREFERRED EMBODIMENT AND THE DRAWINGS

Figure 3:
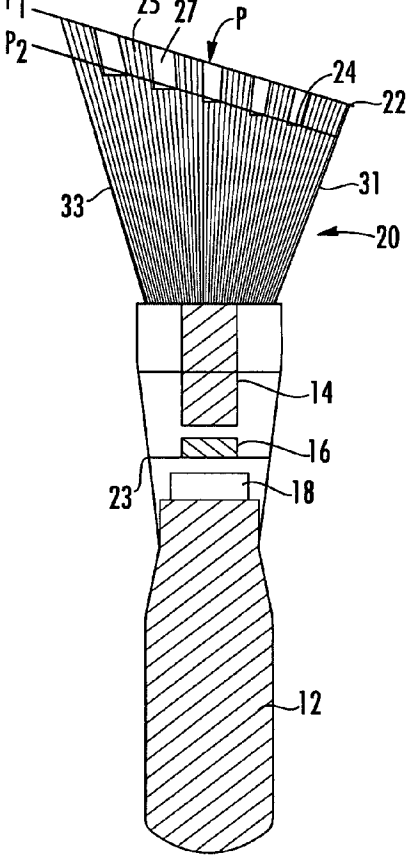
FIG. 3 is a sectional view of the cosmetics brush of FIGS. 1-2 in accordance with the invention.
Figure 2:
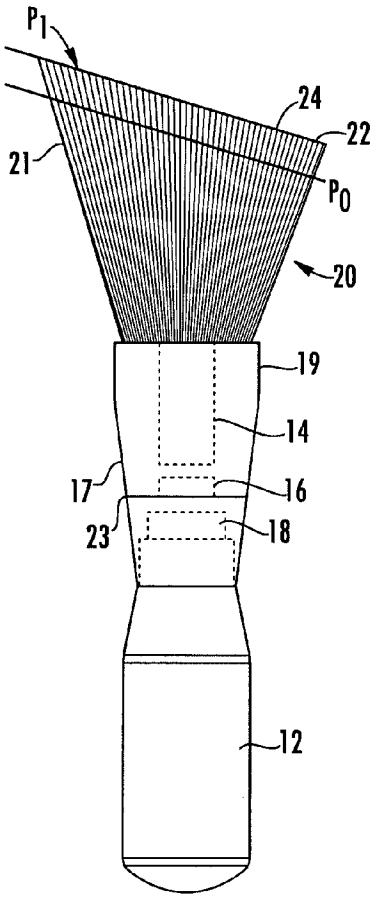
FIG. 2 is a side view of the cosmetics brush shown in FIG. 1 in accordance with the invention.
Figure 1:
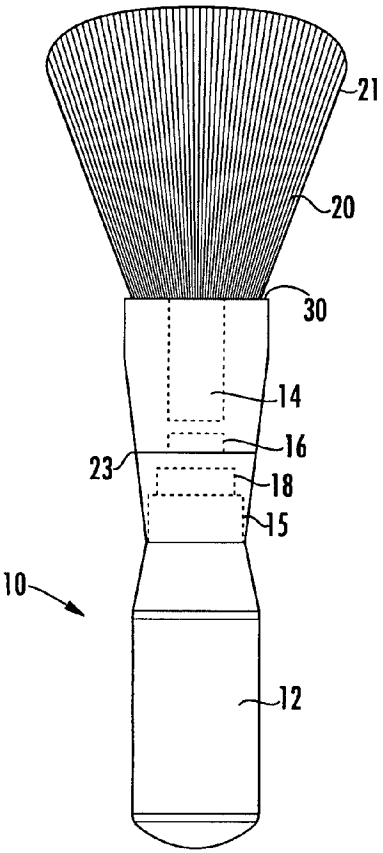
FIG. 1 is a front view of a cosmetics brush in accordance with the invention.

Description of the invention will now be given with reference to FIGS. 1-3. It should be understood that these figures are exemplary in nature and in no way serve to limit the scope of the invention, which is defined by the claims appearing hereinbelow.

The inventive cosmetic brush 10 includes, as does most brushes, a handle 12 and a plurality of tightly packed (at their base) bristles 20 attached the distal end 30 of handle 12. A metal ferrule element is generally used for this purpose. More specifically, a metal cylinder is secured, usually by crimping but other adhesive means or connections can be made) to the distal end of the handle. If crimping is used, the distal end of the handle is usually provided with a neck area 15 of slightly reduced diameter. The ferrule 17 slides over the end of the handle at the neck area and is then secured thereto. Securement can be by crimping, by adhesive, by nails passing through the end of the ferrule and into a wooden end of the brush or a combination of similar mechanical, chemical or other connections.

The ferrule 17, in the preferred and shown embodiment, flares outwardly from where it secures to neck end 15 of the handle 12. There, a plurality of bristles are secured in a conventional manner. The ends of the bristles secured within the larger end 19 of the ferrule 17 are closely packed. The ends of the bristles which are secured within the flared end 19 of the ferrule can be glued together, held by a wire wrapped around their ends, a rubber band, etc. The flared end 19 of the ferrule then covers the ends of the bristles with the free ends 21 of the bristles extending outwardly from the ferrule and handle. As a consequence of the ends of the bristles being held tightly within the ferrule, as they extend away from the handle, they naturally flare out and some small space exists between adjacent individual strands of the bristles. Thus the diameter of the bristles at the point where they are secured within the ferrule, as at 19, is clearly (and not remarkably) smaller than the unconstrained diameter of the bristles at their free end 21. The spacing between the bristles allows them to more gently pass over the irregularities, bumps and depressions of a face as the brush is swept thereacross.

Brush 10 also includes a magnetic element 16 preferably a small cylindrical or disc-like element disposed within the ferrule. It could of course also be a spherical or round ball. As shown in FIGS. 1-3, it is preferred that magnetic element 16 be generally aligned with the central axis of the handle, ferrule and bristles. However, the magnet 16 is smaller in outside diameter than the inside diameter of the ferrule. Also, the ferrule is provided with a small shelf 23 extending across its hollow interior to support the magnetic element 16 thereon. In this manner, it should be appreciated that the magnetic element 16 can slide across and upon the shelf 23 and depending upon direction, speed and force the magnetic element 16 will hit against the interior side wall of the ferrule, slide across to the other side and/or swirl around the inside wall of the ferrule (if the handles is rotated about its longitudinal axis). The weight and strength of the magnetic element is not great so that it can easily move within the ferrule and slide on the shelf 23. Indeed, the strength of the magnet is not great in that it is intended for the magnet to attract some small ferro-magnetic or iron-based cosmetic powders to the free ends of the bristles but the magnetic element should not be so strong as to draw either the larger powder particles or clumps or even the small particles down toward the tightly packed end of the bristles. An iron-based or other metallic rod 14 can be centrally located within ferrule 17 to focus the flux/strength of the magnetic element 16 and to carry its magnetic attractive characteristics from the magnetic element 16 down the length of the ferrule 17 and toward the tightly packed end of the bristles. Preferably, as seen in the Figures, the bottom end of the rod 14 is spaced above the magnetic element 16 and the other or distal end of the cylinder is coplanar with the flared end of the ferrule.

The handle may be provided with a cavity (not shown) for holding one or more batteries which can, by suitable, electrical means, charge the magnetic element 16 so that even if not inherently magnetic it is magnetic as a consequence of the principles of electromagnetism. The neck of the handle can be provided with screw threads which mate with screw threads of the proximal end of the ferrule so that the handle can be selectively disconnected in order to gain access to the battery compartment, a hollow and central cavity of the handle.

The brush may additionally or alternatively include a motor, electrically connected to the battery and an accessible (to the exterior of the handle, preferably) on/off switch for the electrical connections. A vibrating element 18, also disposed in the ferrule 19, can be secured to the motor. In the preferred embodiment, the vibrating element is an off-center cam possibly secured to a rotating shaft of the motor which causes the handle, the magnetic element 16 and the bristles, however slightly, to vibrate when the motor is activated. Vibrating element 18 is shown in the drawings to be disposed near the distal end of handle 12 and just below the magnetic element 16 and its shelf 23; however it may be disposed at any location in handle 12 or within ferrule 19 (or even within the bristles). However, clearly, the motor and its shaft, and the vibrating element should not emerge from the bristles and come into contact with a face as the brush is used on a skin surface. The vibrating element, preferably a small motor provided with an eccentric cam, can be similar to that now provided in current Gillette hand razors. Power supply (one or more small batteries) may be provided to supply power to the motor and the associated vibrating element 18 and/or by induction to magnetic element 16 (if magnetic element 16 is to function as an electromagnet).

Bristles 20 of brush 10 are preferably provided in at least two distinct and aligned tiers or lengths, extending from the flared end 19 of the ferrule. First, a longer length of bristles forms a first tier 22 (see FIG. 3) and then a shorter length of bristles forms a second tier 24. The tiers are cut into the bristles by a cross-cutting of the flared end of the bristles by scissors or another cutting mechanism. The tiers form a cross-hatch of shorter length bristles adjacent to longer length bristles on four sides (when the tiers are in the center of the flared end of the bristles) and, correspondingly each longer length tier in the center of the flared end of the brush head is surrounded on four sides to shorter length bristles. It is preferred that the tips of the longer 25 and the shorter 27 sets of bristles 20 lie in parallel planes $P_1$ and $P_2$ (see FIGS. 2 and 3). This provides a flared end to the bristles. So, some of the shorter bristles 27 are very short, as at the end 31 of the bristles, while some of the shorter bristles are longer as at end 33 of the brush's head. The shorter bristles 27 thus gradually extend in length from end 31 to end 33. Similarly, the longer bristles 25 are shortest at end 31 of the brush head and extend to their maximum length at end 33. As can be seen, however, a pair of parallel planes $P_1$ and $P_2$ are defined by long bristles 25 of varying lengths and short bristles 27 of varying length, respectively. Thus, as can be seen from a review of the Figures, the tips of the respective tiers of bristles lie at an angle to the longitudinal axis of handle 12 (e.g., other than 90°), i.e., the end of the brush is flared for better distribution of cosmetic powder especially as the brush is passed over and swirled on the three dimensional (non-flat) face of a cosmetic wearer. As shown in the drawings, the tiers 22 and 24 of bristles 20 are interleaved with alternating longer and shorter sections. By providing the bristles in such a distribution, the brush better follows the three-dimensional contours of the face, which has a complex topography. The cross-cut of the bristles (long and short bristles), combined with the flare of the brush from one end 31 to the other 33, in general, provides excellent cosmetic placement, smoother application and a superior removal of excess cosmetic.

In use, the brush is used to apply, smooth, move on the face and remove excess cosmetic powder from the face. While it is certainly contemplated that the brush be used with iron-based powders, of course, the brush is not limited to that usage. It can be used with all powder cosmetics in that the shape of the bristles, flared and cross hatched provides even application, movement of cosmetic particles and removal of excess particles.

However, the brush is also intended for use with cosmetic powder containing iron particles. As a consequence of the size and strength of the magnetic element within the ferrule, the brush will pick up and hold, by magnetic attraction and as a consequence of the simple attractiveness of particles to brush bristles, a quantity of cosmetic powder. Small particles will be held to the ends or tips of the bristles and, yet, the magnetic element is intended to be sufficiently small and weak such that the larger or clumped particles of the cosmetic powder are not picked up by the brush from the cosmetic compact or case.

Then, the cosmetic is applied to the face and the bristle tips glide over the peaks and valleys of the face as a consequence of the cross-hatching of the brush's ends and the flaring of the bristles from one end of the brush to the other.

The swirling and sweeping movement of the brush across the contours of the face causes some of the particles on the brush to be deposited on the face. Some of the particles will be shifted from one location to another as the brush continues to sweep and swirl over the face. Also, some of the cosmetic particles will be swept off and swirled off the face as the user continues to sweep and swirl the brush over her face.

The magnetic element facilitates the movement of the iron-based or magnetic particles onto, across and off of the face. More specifically, the magnetic element serves to initially attract and hold the smaller particles which are magnetically attracted. Continued swirling and sweeping, however, depending upon the speed of movement of the device causes the particles to be redistributed and to some degree excess cosmetic particles are swept off the face. To the extent that the magnetic element (whether permanent disc magnetic element or electromagnetic element) holds the particles, as the magnetic element within the brush is moved by sweeping and swirling of the brush (about its longitudinal axis) the cylindrical side wall of the magnetic element will "crash" or be moved against and around the inside wall of the ferrule. This interaction between magnetic element and inside wall of the ferrule and the cessation of momentum of the disc vis a vis the brush will thus cause dislocation of some particles from the brush and removal of excess cosmetic powder.

The device, as mentioned, can be provided with an electromagnetic element and, to this extent, the user can selectively turn on and off the electromagnetic element by activating the battery via the on/off switch.

Of course it should be easily understood that the device, if equipped with the motor and vibrating element, could be selectively activated and that, too, would result in the application of small particles of cosmetic powder, the movement of the same on the face and the selective removal of excess, as the brush is swept across and swirled over the contours of the face.

Having described certain embodiments of the invention, it should be understood that the invention is not limited to the above description or the attached exemplary drawings. Rather, the scope of the invention is defined by the claims appearing hereinbelow and any equivalents thereof as would be appreciated by one of ordinary skill in the art.

What is claimed is:

1. A cosmetics brush for use with powder cosmetics comprising:

a handle having a proximal end and a distal end;

a substantially circular ferrule attached to said distal end and defining an interior cavity;

bristles secured to the end of said ferrule; and a magnet disposed within said ferrule and being smaller in area than the interior cavity defined by said ferrule so that said magnet is configured to move within said ferrule and hit against its sides as said brush is moved;

wherein said magnet is sized to attract fine particles of cosmetic powder when said brush is used to apply powder-based cosmetics.

2. A cosmetics brush according to claim 1, wherein said magnet comprises a permanent magnetic element.

3. A cosmetics brush according to claim 1, wherein said magnet comprises an electromagnetic element powered by a power source contained within said brush.

4. A cosmetics brush according to claim 3, further comprising a vibrating element disposed in said ferrule of said handle, said brush further comprising a power source disposed in said ferrule or said handle, said power source serving to power both said electromagnet and said vibrating element.

5. A cosmetics brush according to claim 1, wherein said bristles further comprise a first relatively longer tier of bristles and a second relatively shorter tier of bristles, said long and said short tiers being cross-cut with respect to one another.

6. A cosmetics brush according to claim 5, wherein said tiers of bristles are distributed in a flared manner.

7. A cosmetics brush according to claim 5, wherein tips of said relative longer of said bristles substantially form a first inclined plane at an angle to the longitudinal axis of said handle.

8. A cosmetics brush according to claim 7, wherein tips of said relative shorter of said bristles substantially form a second parallel plane to said first plane of said bristles of said relative longer of said bristles.

9. A cosmetics brush according to claim 1, further comprising a vibrating element disposed in said ferrule or said handle, said brush further comprising a power source disposed in said ferrule or said handle for mechanically driving said vibrating element.

10. A powder cosmetics brush, comprising:

a handle having a proximal end and a distal end;

a ferrule attached to said distal end of said handle and defining an interior cavity;

bristles disposed within said ferrule and being cross-cut and flared with respect to the longitudinal axis of said handle and an electromagnet located within said ferrule having a power source contained within said handle, said power source serving to energize said electromagnet and to cause said handle to vibrate.

11. A brush as claimed in claim 10 wherein said bristles are arranged in a first relatively longer tier of bristles and a second relatively shorter tier of bristles wherein the tips of said relative longer and relative shorter tiers of bristles lie in parallel planes, said bristles, when assembled, flaring from one side of said bristles to said opposed side.

12. A brush according to claim 10, wherein the tips of said bristles substantially form an oval.

* * * * *